US009290994B2

(12) United States Patent
Webb

(10) Patent No.: US 9,290,994 B2
(45) Date of Patent: Mar. 22, 2016

(54) SONDE HOUSING AND BIT BODY ARRANGEMENT FOR HORIZONTAL DIRECTIONAL DRILLING

(71) Applicant: Charles T. Webb, Aledo, TX (US)

(72) Inventor: Charles T. Webb, Aledo, TX (US)

( * ) Notice: Subject to any disclaimer, the term of this patent is extended or adjusted under 35 U.S.C. 154(b) by 513 days.

(21) Appl. No.: 13/726,772

(22) Filed: Dec. 26, 2012

(65) Prior Publication Data

US 2013/0168154 A1 Jul. 4, 2013

Related U.S. Application Data

(60) Provisional application No. 61/581,380, filed on Dec. 29, 2011.

(51) Int. Cl.

| | |
|---|---|
| ***E21B 7/04*** | (2006.01) |
| ***E21B 10/00*** | (2006.01) |
| ***E21B 10/42*** | (2006.01) |

(52) U.S. Cl.

CPC ..... *E21B 7/046* (2013.01); *E21B 10/00* (2013.01); *E21B 10/42* (2013.01)

(58) Field of Classification Search

CPC ..... E21B 10/00; E21B 7/046

See application file for complete search history.

(56) References Cited

U.S. PATENT DOCUMENTS

| | | | | |
|---|---|---|---|---|
| 3,342,532 | A | 9/1967 | Krekeler | |
| 3,821,993 | A | 7/1974 | Kniff et al. | |
| 5,541,889 | A | 7/1996 | Priest et al. | |
| 6,142,244 | A | 11/2000 | Hesse | |
| 6,148,935 | A * | 11/2000 | Wentworth et al. | 175/398 |
| 6,705,406 | B2 | 3/2004 | Das et al. | |
| 6,749,030 | B2 | 6/2004 | Blair et al. | |
| 7,665,544 | B2 | 2/2010 | Forgang et al. | |
| 7,954,225 | B2 | 6/2011 | Webb | |
| 2009/0250265 | A1 | 10/2009 | Wentworth | |
| 2010/0263930 | A1 | 10/2010 | Wentworth | |
| 2011/0031018 | A1 | 2/2011 | Montgomery | |
| 2011/0203394 | A1 | 8/2011 | Tinlin | |
| 2012/0241218 | A1 * | 9/2012 | Chau et al. | 175/45 |

OTHER PUBLICATIONS

IDS, The IDS V-Series Pilot Boring System, 1 information sheet, 2001.

* cited by examiner

*Primary Examiner* — William P Neuder

(74) *Attorney, Agent, or Firm* — Geoffrey A. Mantooth; Brian K. Yost

(57) ABSTRACT

A horizontal directional drilling sonde housing has a cavity for receiving a sonde. Signal channels extend from the cavity to an exterior of the housing. A polymer lines at least part of the cavity and fills the signal channels. The drilling tool has a bit body and a drilling body. The two bodies have respective lateral surfaces which engage each other to prevent the transverse movement of the drilling body relative to the bit body during operations. The drill bit has a forward extending drill tooth, which drill tooth is removable from a bore. A spacer is located in the bore between the bottom end of the bore and the tooth. The drilling bit has buttons located on the side in a spiral configuration about a longitudinal axis of the bit.

4 Claims, 10 Drawing Sheets

34
35B
35A
25
55
25
34
35
35A
35B
XIV
XIV
53

XIII
XIII
34
25
55

2
101
101
83

87
85
91
75
65
73
71
69
61
99
67
2
63

89
85
91
75
65
97
101
95
93
2

2
101
83
99
93
95
101
101

XVI
61
71
65
7
3
89
87
63
2
91
89
85
XVI

DIA. X
DIA. Y
DIA. Z

SONDE HOUSING AND BIT BODY ARRANGEMENT FOR HORIZONTAL DIRECTIONAL DRILLING

This application claims the benefit of U.S. provisional application Ser. No. 61/581,380, filed Dec. 29, 2011.

FIELD OF THE INVENTION

The present invention relates to horizontal directional drilling and in particular to sonde housings and bit bodies.

BACKGROUND OF THE INVENTION

In horizontal directional drilling (HDD), boreholes are drilled into the earth in generally horizontal directions. A drill string is provided with a bit body, which couples to a drill bit or a blade. The drill bit (or blade) and drill string drill the borehole.

Such boreholes are used, for example by utilities for communication lines, sewer lines, etc. If a utility line is to be buried beneath a road, rather than tear up the road and disrupt traffic, a borehole is drilled beneath the road and the line is pulled through.

In HDD, it is desirable to control the direction of the borehole. This allows the borehole to be drilled at a controlled depth and miss other buried items such as lines, building foundations, tunnels, etc. A transmitter, or sonde, is provided in the drill string close to the drill bit. The sonde is located in a housing that forms part of the drill string. The housing has a cavity for the sonde. Ports or slots extend from the cavity to the outside of the housing. These slots allow the transmitter signal to escape the metal housing. Without the slots, then the housing typically provides too much shielding and attenuates the transmitter signal to the point where it cannot be detected on the surface.

On the surface, an operator uses a receiver to determine the location of the sonde and thus the borehole. In this manner, the borehole can be drilled and extended to the desired locations.

Currently, the slots in the sonde housing are open to the exterior. Debris enters the cavity through the slots. The debris packs in around the sonde, making removal of the sonde difficult. The sonde must be removed periodically to replace its batteries.

In the prior art, some efforts have been made to close off the slots by epoxy. In Blair, U.S. Pat. No. 6,349,778, the slots for the transmitter signal are filled with epoxy. In addition, the sonde is located on a polyurethane liner. However, during drilling operations, the rotating drill sting encounters severe vibrations as the drill bit cuts its way through the earth. These vibrations shake loose such materials used to fill up the slots. Also, the epoxy in the slots can be pushed into the sonde housing and damage the sonde.

The sonde housing is typically located near the bit body. Various types of drill bits and blades are used in drilling. For example, a tooth bit is used for hard conditions where rock is encountered. The bit has teeth projecting therefrom, which teeth contact the rock. More moderate or soft conditions may not need a tooth bit, but rather a blade. Such moderate or soft conditions have little or no rock. It is desirable to easily configure the drill string to match the conditions encountered in the drill hole.

Different bit bodies are used to match the bit or blade needed. For example, a specific bit body is used with a drill bit, while another bit body is used with a blade. Drill bits encounter high loading (such as side loads) during drilling operations. The bit body is matched to the drill bit in order to accommodate the loads. Such bit bodies cannot be used with blades.

In addition, tooth-type drill bits have drill teeth that project forward from the drill bit. Different drilling conditions may call for different tooth arrangements. Yet in the prior art, in order to vary the tooth arrangement, another drill bit must be used.

SUMMARY OF THE INVENTION

A horizontal directional drilling sonde housing comprises first and second ends. The first end is capable of coupling to a drill string. A mud channel extends in between the first and second ends. A cavity is located in the housing and is separate from the mud channel. An opening allows access to the cavity from an exterior of the housing. The cavity is capable of receiving a sonde. A door closes the opening. Signal channels extend from the cavity to the exterior of the housing. A polymer lines at least part of the cavity so as to be interposed between the sonde and the housing. The polymer fills the signal channels.

In accordance with one aspect, each of the signal channels comprises an intermediate section and an exterior section. The intermediate section is smaller in a first dimension than the exterior section. The polymer is located in the intermediate and exterior sections and fills both sections.

In accordance with another aspect, the intermediate section is smaller in a second dimension than the cavity. The polymer in the cavity, the intermediate section and the end section are integral.

In accordance with another aspect, the door comprises a signal channel. The polymer and the door signal channel is "I" shaped in transverse cross-section.

A method of making a horizontal directional drilling sonde housing comprises providing the sonde housing with a cavity for a sonde and signal channels extending from the cavity to an exterior of the housing. A flowable polymer is added to the cavity and is allowed to flow into the signal channels. A mold is inserted into the cavity so as to shape the polymer located in the cavity. The polymer is allowed to set and the mold is removed from the cavity.

In accordance with one aspect, the signal channels are closed off at the exterior before adding the flowable polymer to the cavity.

In accordance with another aspect, the mold that is inserted into the cavity comprises inserting a center mold. Also, an end mold is inserted into the cavity so to reduce a length of the cavity before adding the polymer.

In accordance with another aspect, the housing is heated before adding the polymer.

In accordance with another aspect, the cavity and the signal channel have interior surfaces. The interior surfaces are roughened before the polymer is added.

A horizontal directional drilling tool comprises a bit body having front and rear end portions with a mud channel extending between the end portions. The bit body has a longitudinal axis. The bit body has a first mounting surface and a first lateral surface. A drilling body is removably mounted onto the bit body. The drilling body has a second mounting surface that contacts a first mounting surface. The drilling body has a second lateral surface that engages the first lateral surface. The first and second lateral surfaces prevent movement of the drilling body relative to the bit body in a direction and transverse to the longitudinal axis.

In accordance with another aspect, the first lateral surface comprises a rear tab on the bit body and the second lateral surface comprises a rear notch on the drilling body.

In accordance with another aspect, the first lateral surface comprises an outer partially circumferential surface of the bit body and the second lateral surface comprises an inside surface of a band coupled to the drilling body.

In accordance with another aspect, the drilling body comprises one of a drill bit and a blade.

In accordance with another aspect, the mud channel has a port that is located on the first mounting surface. The drilling body has a second mud channel that communicates with the port and extends to a forward end of the drilling body.

In accordance with another aspect, the mud channel has a port located at the forward end of the bit body.

A horizontal directional drilling tool comprises a bit body having front and rear end portions with a mud channel extending between the end portions. The bit body has a first mounting surface and a first pin hole extending from the first mounting surface into the bit body. The bit body has a transverse pin hole that extends from an exterior of the tool to transversely intersect the first pin hole. A drilling body is removably coupled onto the bit body. The drilling body housing has a second mounting surface that contacts the first mounting surface. The drilling body has a second pin hole that aligns with the first pin hole when the drilling body is mounted onto the bit body. A coupling pin is inserted into the first and second pin holes. The coupling pin has a hole therein that aligns with the transverse hole. A transverse pin is inserted into the transverse pin hole and into the first pin hole. A retainer ring is located on the transverse pin and is received by a groove in one of the transverse hole or the coupling pin hole.

In accordance with one aspect, the drilling body is a rock bit.

In accordance with another aspect, the drilling body is a blade.

A horizontal directional drilling drill bit comprises a bit mass having a forward end. The bit mass having at least one bore. The bore has a bottom end. A drill tooth is located in the bore and extends forward. The drill tooth is removable from the bore. A spacer is located in the bore between the bottom end and the tooth.

A horizontal directional drilling drill bit comprises a bit mass having a forward end, a longitudinal axis, and sides extending along the longitudinal axis. Buttons are located on the side. The buttons are arranged in a spiral configuration about the longitudinal axis.

In accordance with another aspect, the spiral configuration is a first spiral configuration and wraps in a first direction about the longitudinal axis. The buttons are arranged in a second spiral configuration that wraps around the longitudinal axis in a direction opposite of the first direction.

DESCRIPTION OF THE PREFERRED EMBODIMENT

Figures 1, 2, 3, 4:
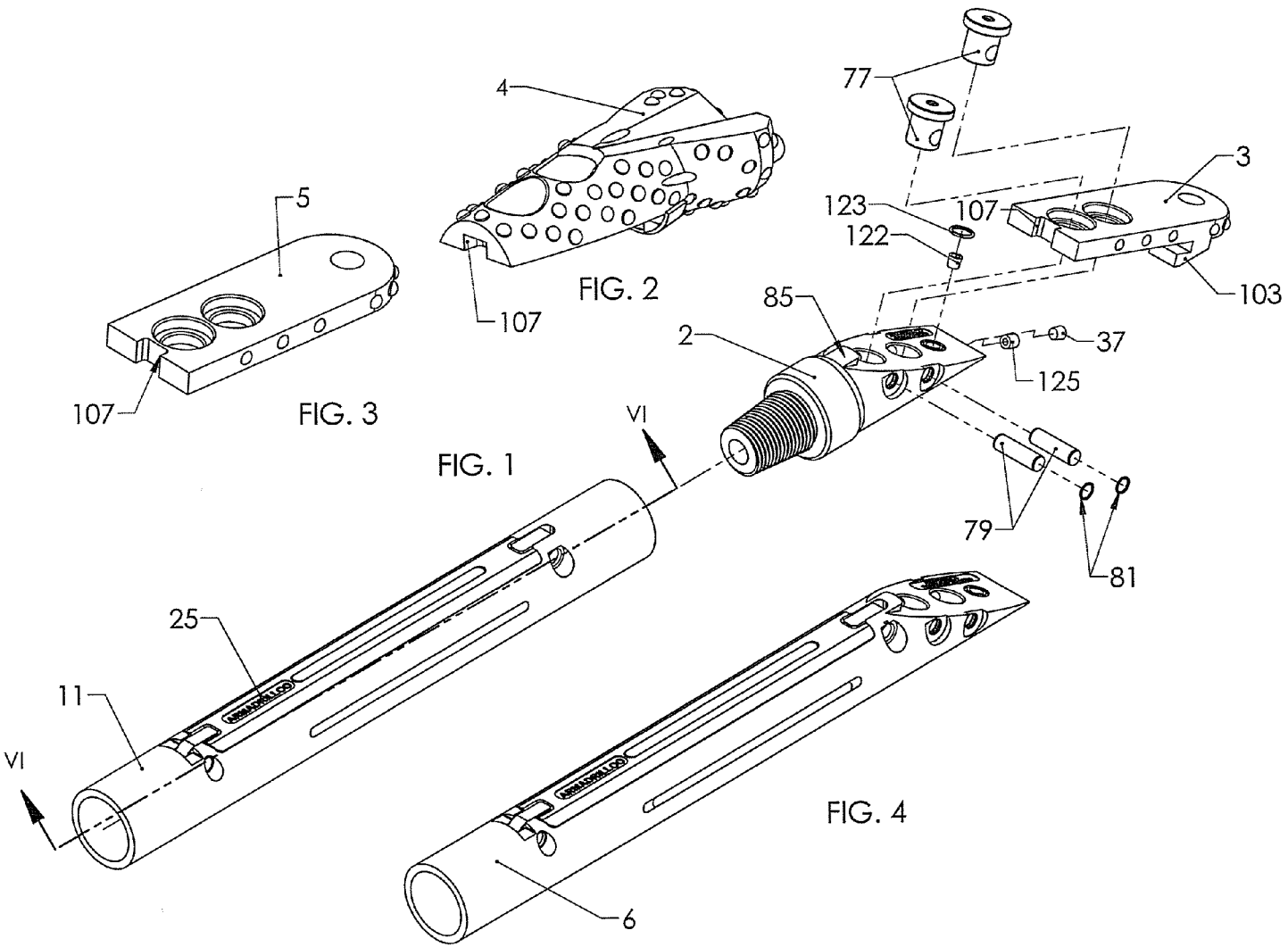
FIG. 1 is a perspective view of the sonde housing and drill bit arrangement in accordance with the preferred embodiment, with a blade for moderate conditions.
FIG. 2 is a perspective view of a drill bit for hard conditions.
FIG. 3 is a perspective view of a blade for soft conditions.
FIG. 4 is a perspective view of the sonde housing and bit body in accordance with another embodiment.

In FIGS. 1-3, there is shown the working end of the drill string of an HDD system. The working end includes a sonde housing 11 and an adjacent bit body 2. The sonde housing is coupled to drill pipe which extends back to the drilling machine. The bit body 2 couples to a drill blade 3, 5 as shown in FIGS. 1 and 3 or to a drill bit 4, as shown in FIG. 2.

The sonde housing 11 has a sonde. The sonde housing provides an insert that surrounds the sonde. The insert allows the sonde signal to pass through the sonde housing for reception on the surface. The insert effectively prevents debris from entering the sonde housing and also provides cushioning against mechanical shock as well as thermal protection.

The bit body 2 couples to the drill bit 4 and also to blades 3, 5. Thus, the bit body 2 need not be changed to couple to a new blade or bit. The bit body couples the drill bit in a fashion that resists side loads. The drill bit 4 is provided with a unique pattern of buttons which enhances drilling through a hard material such as rock. Furthermore, the arrangement of projecting teeth can be changed to provide a more or less aggressive posture in the teeth.

FIG. 4 shows another embodiment where the sonde housing and the bit body are in one unit 6. In FIG. 1, the bit body 2 is coupled to the sonde housing 11 by a threaded fitting.

The sonde housing 11 will be described first, followed by a description of the bit body and the bit and the blades.

Figure 5:
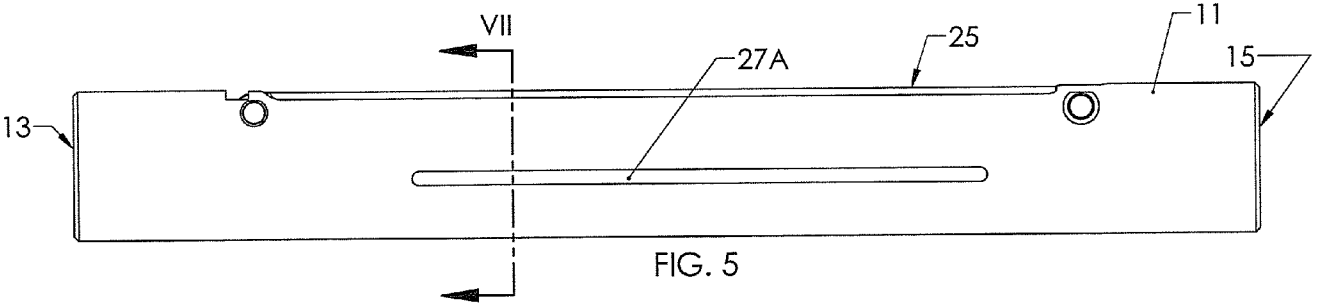
FIG. 5 is a side view of the sonde housing.
Figure 6:
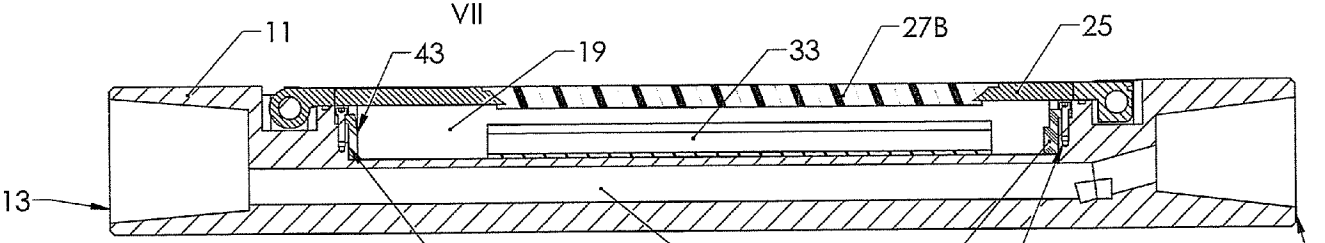
FIG. 6 is a longitudinal cross-sectional view taken through lines VI-VI of FIG. 1.
Figure 7:
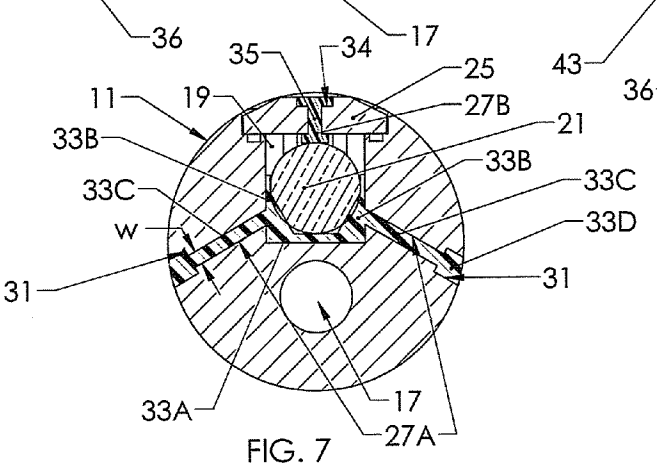
FIG. 7 is a transverse cross-sectional view taken through lines VII-VII of FIG. 5.

Referring to FIGS. 5-7, the sonde housing 11 is generally cylindrical having two ends with threaded connections. One end 13 is connected to a drill pipe, which drill pipe extends back toward a drilling machine. The other end 15 is connected to the bit body 2. The ends 13, 15 are threaded for coupling to the drill pipe and the bit body. Alternatively, the ends can utilize pinned couplings, such as described in my U.S. Pat. No. 7,954,225, the complete disclosure of which is incorporated by reference herein. A fluid channel 17 extends between the two ends 13, 15. Drilling fluids or mud flows through the fluid channel 17 during drilling operations.

The sonde housing 11 has a cavity 19 for receiving a sonde 21 or transmitter. The cavity 19 is accessible from the exterior by way of a port or opening 23 (see FIG. 8). The port 23 is closed by a door 25. Signal channels 27A, 27B extend from the cavity 19 through the housing to the exterior of the housing. As shown in FIG. 7, there are two lateral signal channels 27A, one on each side (with respect to the orientation of FIG. 7) of the cavity. Another channel 27B extends through the door. The channels have some longitudinal length, and as shown in FIGS. 1 and 5, appear as slots. The channels 27A, 27B converge on the cavity 19 and allow the transmitted signal from the sonde 21 to pass through the sonde housing.

Each lateral channel 27A has a predetermined transverse cross-sectional width W, as shown in FIG. 7. This width is increased by way of a counter slot 31 located at the exterior. The door channel 27B also has a predetermined transverse cross-sectional width, which width is increased by a counter slot 34 located at the exterior.

The cavity 19 and the slots 27A, 27B are provided with an insert 33 made of polymer material. In the preferred embodiment, the polymer is polyurethane (referred to herein as urethane). Other types of polymers can be used, such as rubber. In the preferred embodiment, the durometer is 75 (Shore A), wherein the polymer provides some cushioning from mechanical shock. Urethane is also abrasion resistant. Furthermore, urethane provides thermal protection for the sonde. Drilling operations generate heat and the urethane extends the life of the sonde.

Referring to the orientation shown in FIG. 7, which is the orientation used for assembly of the sonde into the sonde housing, the insert 33 has a bottom portion 33A located along the bottom of the cavity 19, side portions 33B extending up the side walls of the cavity for a distance, lateral channel portions 33C and the lateral channels 27A, and counter slot portions 33D in the counter slots. The insert bottom portion 33A, side portions 33B, lateral channel portions 33C and counter slot portions 33D are integral in one piece. The sonde 21 is located on top of the bottom portion 33A, with the side portions 33B contacting the sonde.

Figure 8:
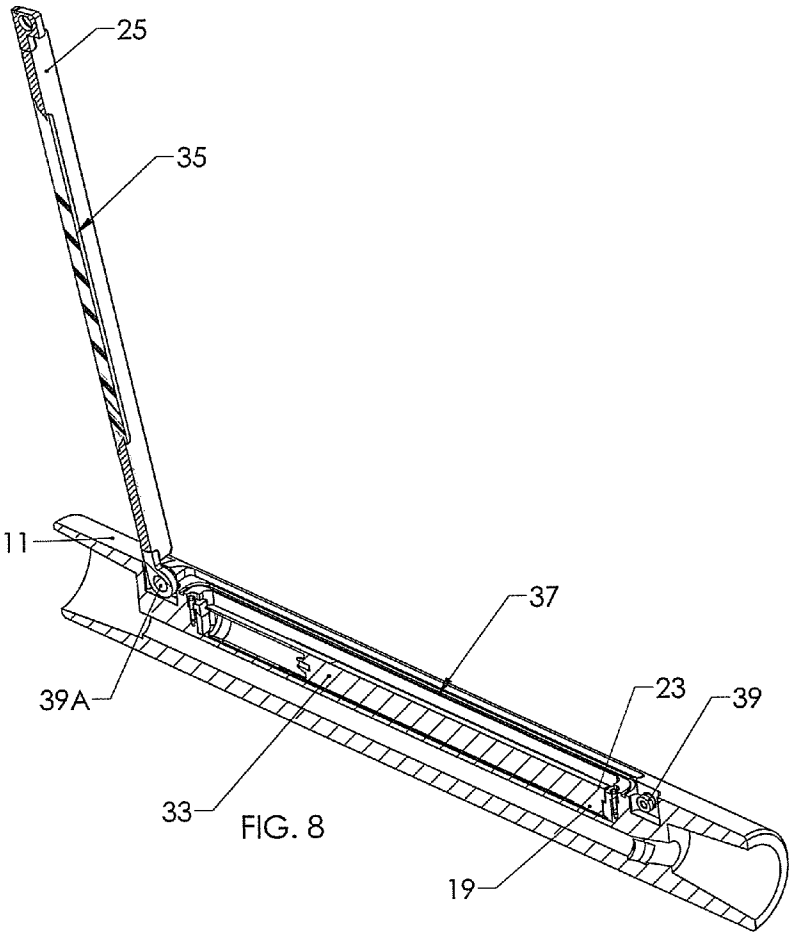
FIG. 8 is a perspective, cut-away view showing the insert located inside of the sonde housing, with the door in an open position.

The insert 33 extends to the exterior surface at the counter slots 31 (see FIGS. 7 and 8). The side portions 33B and counter slot portions 33D are enlarged relative to the lateral channel portions 33C. These enlarged portions serve as anchors or stops that prevent the portions 33C located inside of the lateral channels from becoming displaced. The enlarged portions 33B, 33D anchor or secure the lateral channel portions 33C in the lateral channels 27A.

Figures 12, 13, 14:
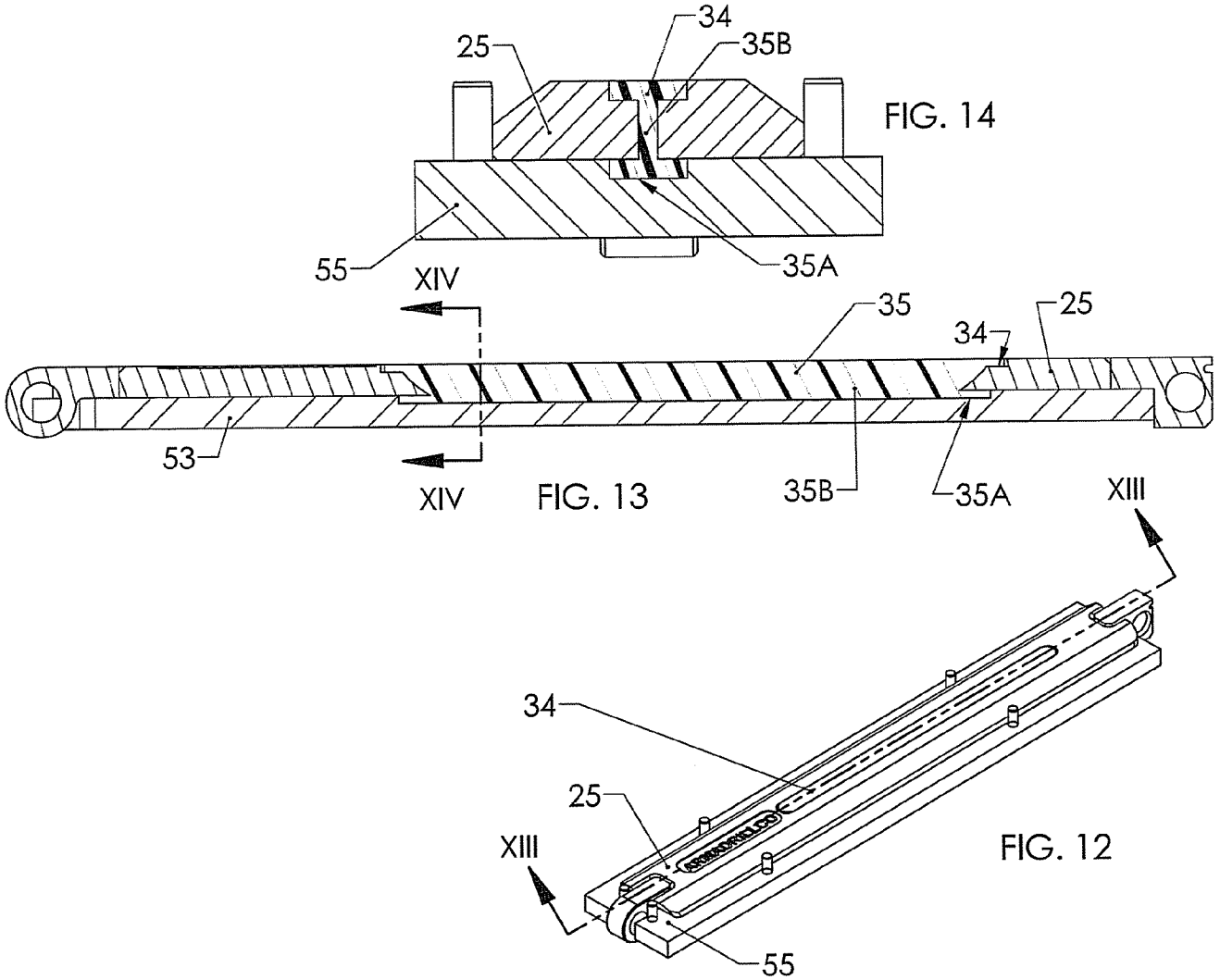
FIG. 12 is a perspective view of the sonde housing door, equipped with a mold.
FIG. 13 is a longitudinal cross-sectional view of the door of FIG. 12, taken through lines XIII-XIII.
FIG. 14 is a transverse cross-sectional view taken through lines XIV-XIV of FIG. 13.

The door channel 27B also has a urethane insert 35. The door insert 35 is separate from the cavity insert 33. The door insert 35 has enlarged exterior and interior ends, or flanges, 35A with a thinner center portion 35B. The insert 35 in the door slot looks like an "I" beam in transverse cross-section (see FIG. 14). The insert 35, with the enlarged ends 35A, remains in place during the operation of the sonde housing, preventing displacement of the insert from the door channel 27B.

Surrounding the port 23 is a groove for receiving an o-ring 37. When the door 25 is closed, the o-ring provides a seal. The door however does not necessarily make a water tight seal. The seal is for keeping debris out of the sonde housing.

The door is secured in place with a pin 39 at the front end (see FIG. 8). The pin 39 is such as described in my U.S. Pat. No. 7,954,225, the complete disclosure of which is incorporated herein by reference. The other end is secured in place by a simple rod or pin 39A that is semi-permanently held in place by a tack weld so that it will not escape the bore. The pin 39A serves as a hinge, wherein the door can swing between open and closed positions. FIG. 1 shows the door 25 in the closed position, while FIG. 8 shows the door in an open position. When the door is closed with the sonde in the cavity, the sonde is contacted by the insert bottom portion 33A and by the door insert 35.

The insert 33 need not extend for the full length of the cavity 19. In the embodiment shown in FIG. 6, the inert extends for the same length as the housing channels 27A and not to the end walls 36 of the cavity. The sonde itself almost fills the length of the cavity. End pieces 43, made of the same material as the insert, are used, one in each end of the cavity 19.

The method of making the inserts 33, 35 will now be described. The inserts are made in situ using the sonde housing 11 and door 25 as molds.

The sonde housing 11 is machined to form the cavity 19, the channels 27A and the counterbores 31. The insert installation is typically the last step in manufacturing the sonde housing. The door is similarly machined to form the respective channel 27B or slot and expanded areas 34.

The surfaces of the sonde housing and the door that will contact the inserts are roughened to increase the adherence of the insert material. One way to roughen the surfaces is by sand blasting.

Figure 10:
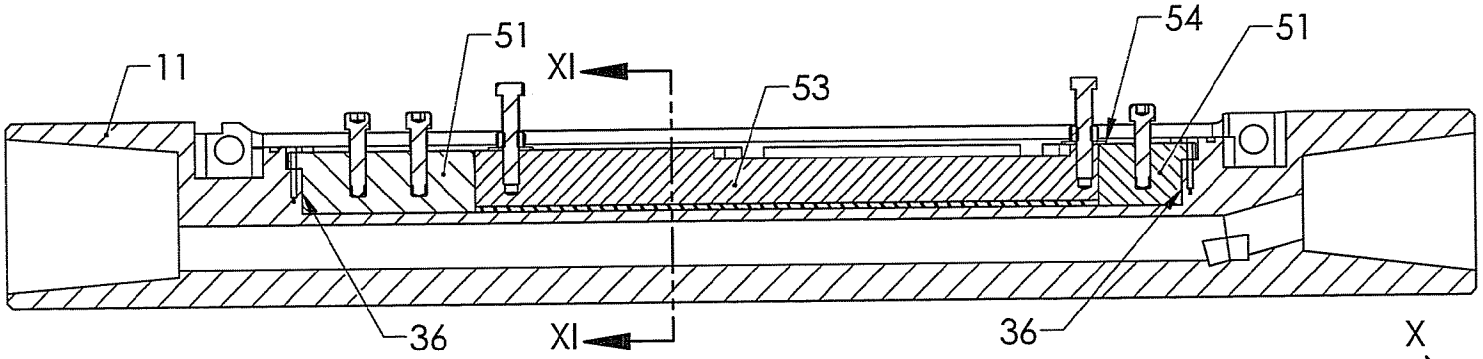
FIG. 10 is a longitudinal cross-sectional view of the sonde housing taken along lines X-X of FIG. 9.
Figure 9:
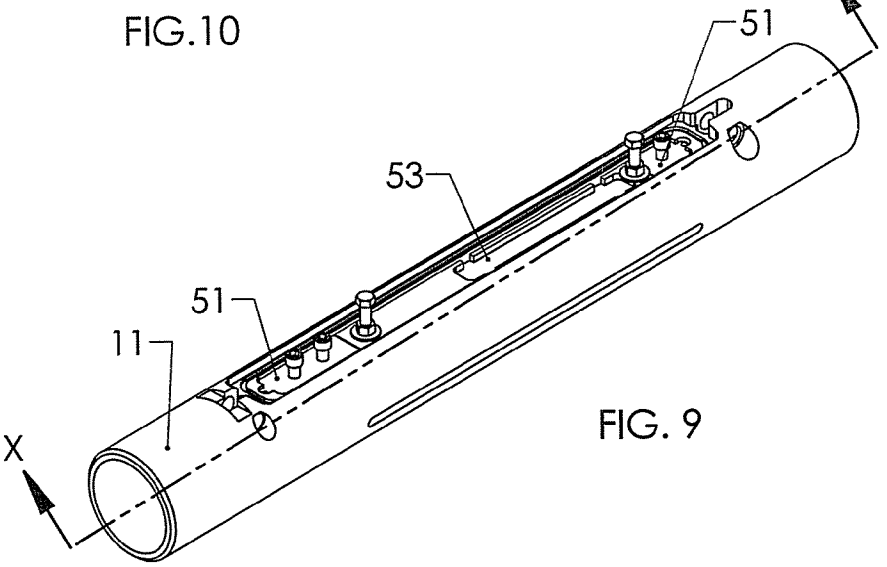
FIG. 9 is a perspective view of the sonde housing, equipped with a mold for making the insert.

On the sonde housing, the exteriors of the channels 27A are closed. For example, tape can be used to cover the channels 27A, or a sleeve is placed over the sonde housing to close off the channels. End molds 51 (see FIG. 10) are placed into the cavity 19, against the end walls 36. The end molds 51 close off the ends of the cavity to the material that will form the insert. The spacing between the end molds determines the length of the insert 33.

Figure 11:
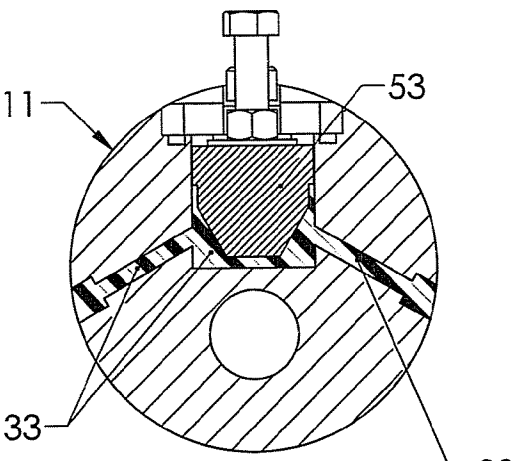
FIG. 11 is a transverse cross-sectional view of the sonde housing taken through lines XI-XI of FIG. 10.

The sonde housing 11 is then heated. The sonde housing is heated in one of several ways. One way is to place the sonde housing in an oven, while another way uses a torch that is directed at the housing. When the housing is heated to the desirable temperature (typically 120-130° F.), a measured quantity of urethane is poured or flowed into the cavity 19 through the open port 23. The urethane is poured along the length of the cavity between the end molds 51. A preheated center mold 53 is then inserted into the cavity (see FIGS. 10 and 11). The bottom side of the center mold is tapered so as to form a channel or groove in the insert 33 along the bottom and side portions 33A, 33B. The center mold 53 is heavy enough to sink on its own into the housing. The center mold has a plate 54 or washer at each end, which plate extends out to bear on the respective end mold 51. The plates 54 thus serve as stops so that the center mold sinks a predetermined distance into the cavity and the bottom portion 33A of the insert is of a predetermined thickness. The urethane is then allowed to cure, after which the molds and tape are removed. The molds 51, 53 are pulled from the sonde housing by way of bolts protruding from the molds. Any excess urethane on the exterior at the counter slots can be trimmed with a knife so as to conform to the cylindrical shape of the remainder of the sonde housing.

The insert 35 of the door 25 is made by attaching a mold 55 to the interior side of the door. The mold has a groove that forms one of the flanges 35A of the insert 35. The door mold is heated and urethane is poured into the channel from the top side, filling the channel. After the urethane cures, the mold 55 is removed and any excess urethane is removed from the exterior.

The provision of enlarged ends 33B, 33D, 35A on the inserts 33, 35 results in the inserts staying in place in the channels and the cavity. The drill bit and sonde housing 11 experience high vibratory loads that easily dislodge mere channel plugs. However, with the insert as shown and described, the insert remains anchored in place by the enlarged ends. Furthermore, the use of a heated sonde housing and door while the insert is being molded results in a stronger bond between the urethane and the housing metal.

The bit body 2 is shown in FIGS. 1, 15-19. The bit body 2 has front and rear ends 61, 63. The rear end 63 is threaded to couple to the sonde housing 11. In the preferred embodiment, the bit body 2 is generally cylindrical. A mounting surface 65 is provided, which surface is angled with respect to the longitudinal axis of the bit body. The mounting surface intersects the front end 61 of the bit body. A fluid channel 67 extends between the two ends 61, 63. This fluid channel is used for the blades 3, 5. A secondary channel 69 extends from the fluid channel to the mounting surface. The secondary channel 69 provides fluids to fluid ports of the drill bit. An o-ring groove 71 is provided for the secondary channel.

Mounting structure is provided on the bit body for mounting the blades 3, 5 and the bit 4 thereto. Blind retainer pin holes 73 are provided on the mounting surface. Transverse pin holes 75 extend from one side of the bit body to the other side and intersect the retainer pin holes 73. Retainer pins 77, locking pins and O-rings can be used as described in my U.S. Pat. No. 7,954,225 to retain or couple the respective blades and bit to the bit body 2 (FIG. 1) or retainer pins 77, hardened dowel pins 79 and retainer rings 81 can be used. After the blade 3, 5 or bit 4 is installed, the retainer pins 77 are inserted in holes 111 on the bit 4 or blades 3, 5 and hole 75 on the bit body 2. Then, hardened dowel pins 79 are inserted intersecting the retainer pins 77 and holes 75 on the bit body 2, then the retainer rings 81 are compressed and inserted into holes 75 until they rest in a groove that is cut in the wall of holes 75. The retainer rings 81 are allowed to expand into the groove and when inserted they fill the groove and have a smaller inside diameter than the outside diameter of the dowel pins 79 (see FIG. 1).

Figures 15, 16, 17, 18, 19:
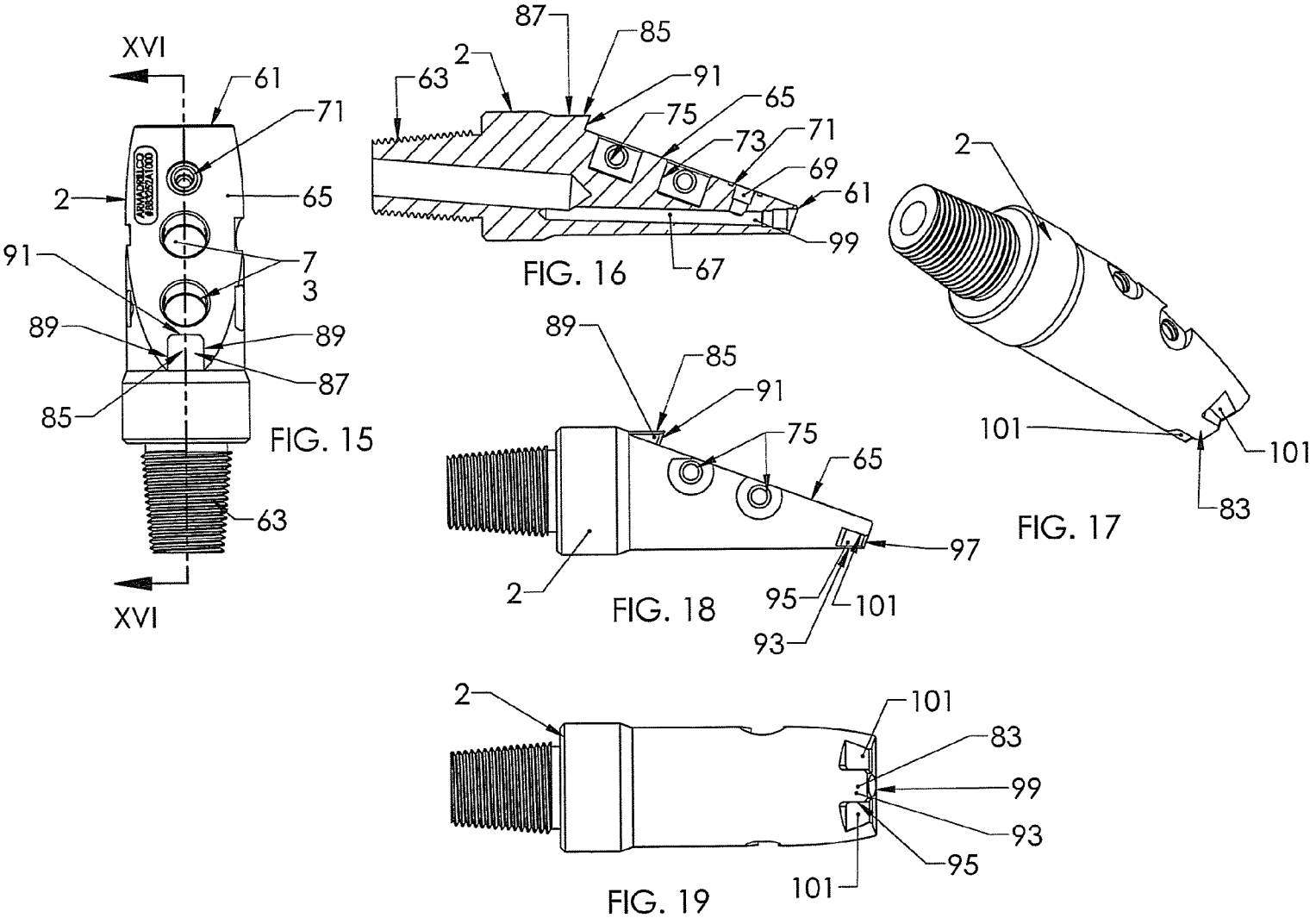
FIG. 15 is a top view of the bit body of FIG. 1.
FIG. 16 is a cross-sectional view of the bit body taken through lines XVI-XVI of FIG. 15.
FIG. 17 is a perspective view of the bit body of FIG. 15 showing the bottom side.
FIG. 18 is a side view of the bit body of FIG. 15.
FIG. 19 is a bottom view of the bit body of FIG. 15.
Figure 20:
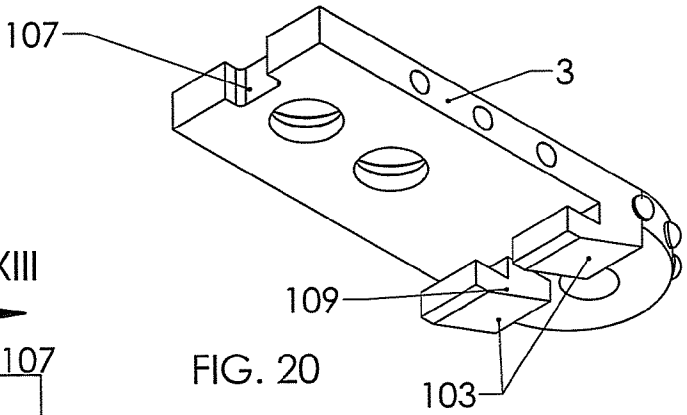
FIG. 20 is a perspective view of the blade of FIG. 1 showing the underside thereof.
Figure 21:
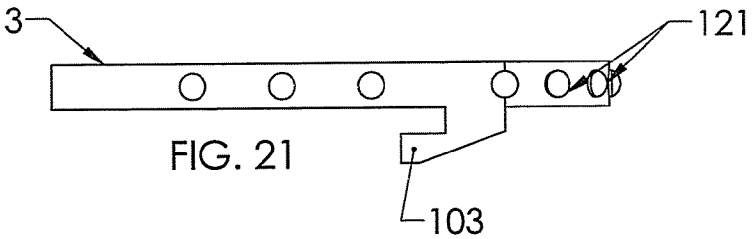
FIG. 21 is a side view of the blade of FIG. 20.
Figure 23:
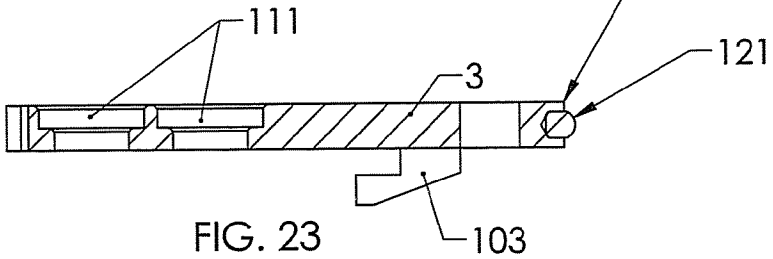
FIG. 23 is a cross-sectional view of the blade, taken through lines XXIII-XXIII of FIG. 22.
Figure 22:
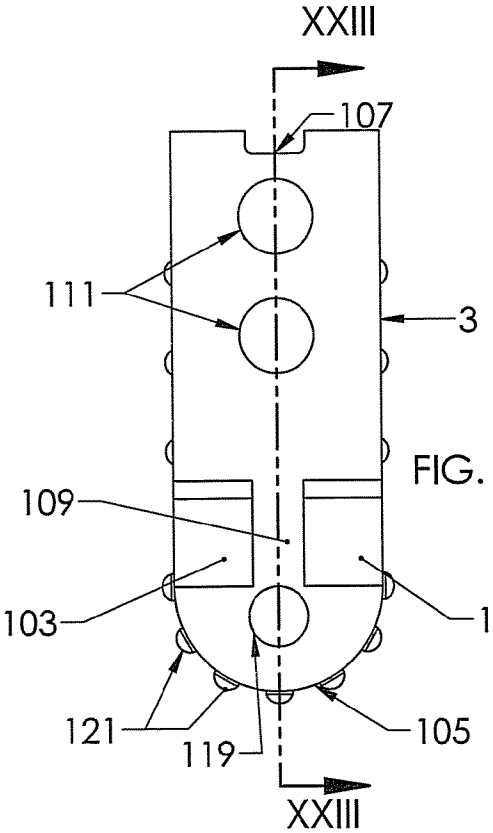
FIG. 22 is a bottom view of the blade of FIG. 20.

To minimize side loading on the bit and selected blades, front and rear tabs 83, 85 are provided. The rear tab 85 is located at the rear of the mounting surface 65. The rear tab 85 is centered on the mounting surface 65 and protrudes forwardly as shown in FIGS. 1 and 15. The rear tab 85 has, referring to the orientation of FIGS. 16 and 18, a top surface 87, two side surfaces 89 and a forward surface 91. The top surface 87 merges with the cylindrical surface of the bit body. The side and forward surfaces 89, 91 are generally perpendicular to the mounting surface 65. The rear tab 85 protrudes above the mounting surface 65. The front tab 83 is similar, having a bottom surface 93, two side surfaces 95 and a front surface 97. The front tab 83 is made by cutouts 101 on each side. The bottom surface 93 merges with the cylindrical surface of the bit body. The side and front surfaces 95, 97 are generally perpendicular to the mounting surface 65. The fluid channel 67 communicates with a port 99 and the front tab front surface 97.

The blade 3 of FIGS. 20-23 is used for moderate conditions. The blade 3 is a plate with a rounded front, or free, end 105. The rear end has a notch 107 for engaging the bit body rear tab 85. The rearward facing hooks 103 are provided on the bottom side of the blade near the front end 105. The hooks 103 are spaced apart from one another to form a front notch 109. When the blade 3 is mounted to the bit body 2, the front tab 83 is located in the front notch 109 and the hooks 103 are located in the bit body cutouts 101. The blade has retainer pin openings 111 that align with the retainer pin holes 73 in the bit body. A pull hole 19 can be provided near the blade free end. Carbide buttons 121 populate the front and side edges.

In operation, the drill string rotates the bit body 2 of the blade 3. Side loads or stresses imparted to the blade are resisted by the hooks 103 and the front tab 83 at the front end, and the notch 107 and the rear tab 85 at the rear end.

In order to divert drilling fluid out of the front port 99 of the drill bit body 2, a plug 122 is provided in the secondary channel 69 (see FIGS. 1 and 16). A fluid jet 125 or nozzle can be provided in the fluid channel.

Removal of the blade from the bit body is accomplished by removing the retainer pins 77, 79.

The drill bit 4 is shown in FIGS. 2 and 24-31. The drill bit is a mass that has front and rear ends 127, 129 and a flat surface 131 that contacts the bit body mating surface 65. A rear notch 107 is formed on the surface, which notch receives the bit body rear tab 85 (like numbers is the drawings are on like parts). A front notch 109 is formed by two rearwardly facing hooks 103, or tabs, on the bottom side of the bit. The bit body front tab 83 is received by the front notch 109. Strap 109A is welded on to and across tabs 103. Strap 109A, which is arcuate, reinforces and strengthens tabs 103.

Figure 35:
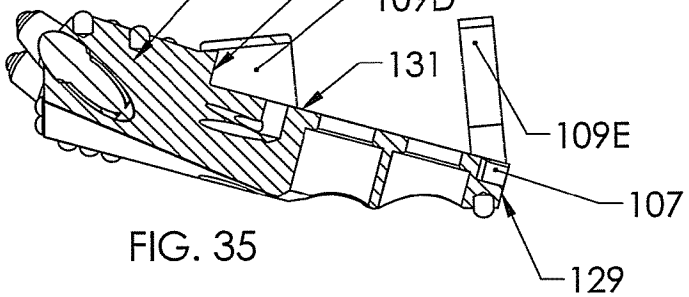
FIG. 35 is a cross-sectional view of the bit of FIG. 34, taken through lines XXXV-XXXV.
Figure 37:
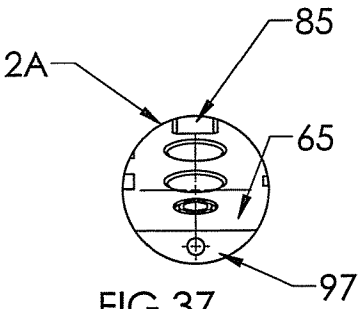
FIG. 37 is a front end view of the bit body of FIG. 36.
Figure 34:
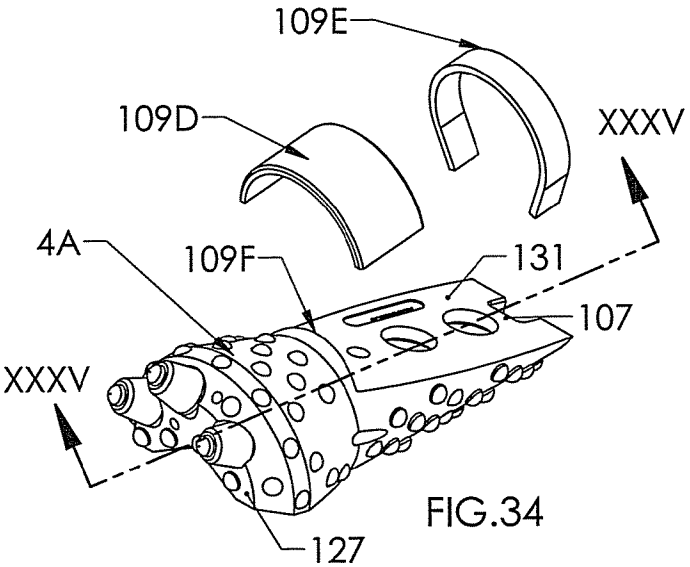
FIG. 34 is a perspective view of the tool bit showing the front end and bottom sides, in accordance with another embodiment.
Figure 36:
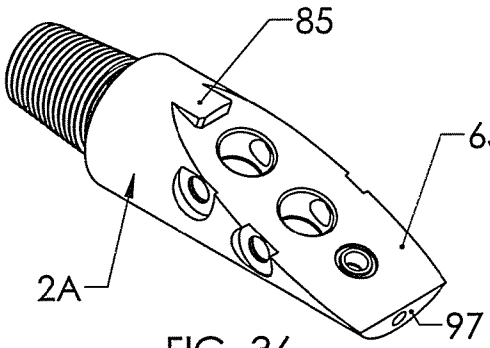
FIG. 36 is a perspective view of the bit body in accordance with another embodiment.

As an alternative, the tabs 103 and notch 109 are eliminated from the drill bit 4A, as shown in FIGS. 34-35. Band, or strap, 109D is used instead. The band 109D is curved to match the end of the bit body 2A (see FIGS. 36-37). The ends of the band 109D are coupled to the drill bit, such as by welding. Once attached to the drill bit, the band forms an opening for receiving the end of the bit body 2A. The bit body 2A need not have a front tab, as shown in FIGS. 36 and 37. The front surface 97 contacts a surface 110 on the drill bit. The band 109D minimizes lateral movement of the drill bit relative to the bit body, as well as any shear forces applied thereto. An optional secondary band 109E can be provided on the bit body near the rear end 129.

Retainer pin openings 111 align with the bit body retainer pin hole 73. The secondary fluid channel 69 of the bit body 2 communicates with a fluid inlet 133 on the flat surface 131. An o-ring 123 (FIG. 1) in the bit body groove 71 provides a seal around the fluid inlet. Channels extend from the fluid inlet to fluid outlets 135 on the bit front end (see FIG. 29). A plug 37 (FIGS. 1 and 16) is inserted into the outlet 99 of the fluid channel at the front end of the bit body so as to divert fluid flow into the fluid inlet of the bit.

The bit is provided with teeth 141 that face generally forward. The teeth are conventional and commercially available. Each tooth has a shank 141B and a head 141C. The head 141C is larger in diameter than the shank. Each tooth is provided with snap ring or band 143. Each tooth is located in a bore 145 (see FIG. 31) that extends from the front end of the bit rearwardly at a desired angle and depth. The bore 145 has two different diameters. The smaller diameter 145A is of sufficient size to accept the shank 141B of tooth 141. A larger diameter bore 145B is provided to accept the head 141C of the tooth 141. The larger diameter bore 145B provides extra lateral support to the tooth 141. A knockout hole 147 intersects the rear end of the bore 145. The knockout hole is coaxial with the bore and allows access to the rear end of the tooth. The tooth 141 is held in place by frictional forces exerted on the wall 149 of the smaller diameter bore 145A by the band 143 of the tooth.

To install a tooth 141, it is pressed into the tooth bore until it bottoms out in the groove. Teeth wear out and must be periodically replaced. To remove a tooth, a shaft is inserted into the knockout hole; the shaft is struck to push the tooth out.

Teeth come in standard lengths. The distance the tooth projects out from the bit can be varied by using tooth spacers 151. A tooth spacer is sized so as to fit in the bottom, or rear end of the tooth bore. The tooth spacer 151 is generally disc shaped (see FIGS. 28 and 31). If the bottom of the tooth bore is beveled, such as due to manufacturing processes, one side 153 of the tooth spacer can be beveled as well. The other side 155 on the tube spacer is flat so as to match and contact the bottom, or rear, end of the tooth. Tooth spacers can be made available in different lengths, for example ¼ inch, ½ inch and ⅝ inch. A tooth spacer causes the tooth to project out further. For example, a ¼ inch tooth spacer causes the tooth to project out ⅛ to ¼ inch (depending on the shape of the bottom of the tooth bore) more than a tooth without a spacer. The wall 149 that receives the tooth band 143 is sufficiently long so as to accept the band for various positions of the tooth, whether with multiple spacers, no spacer, or with a larger spacer available. To save cost use of multiple shorter spacers stacked upon each other will work as well as using spacers of different lengths.

Figures 24, 25, 26, 27, 28, 29, 30, 31:
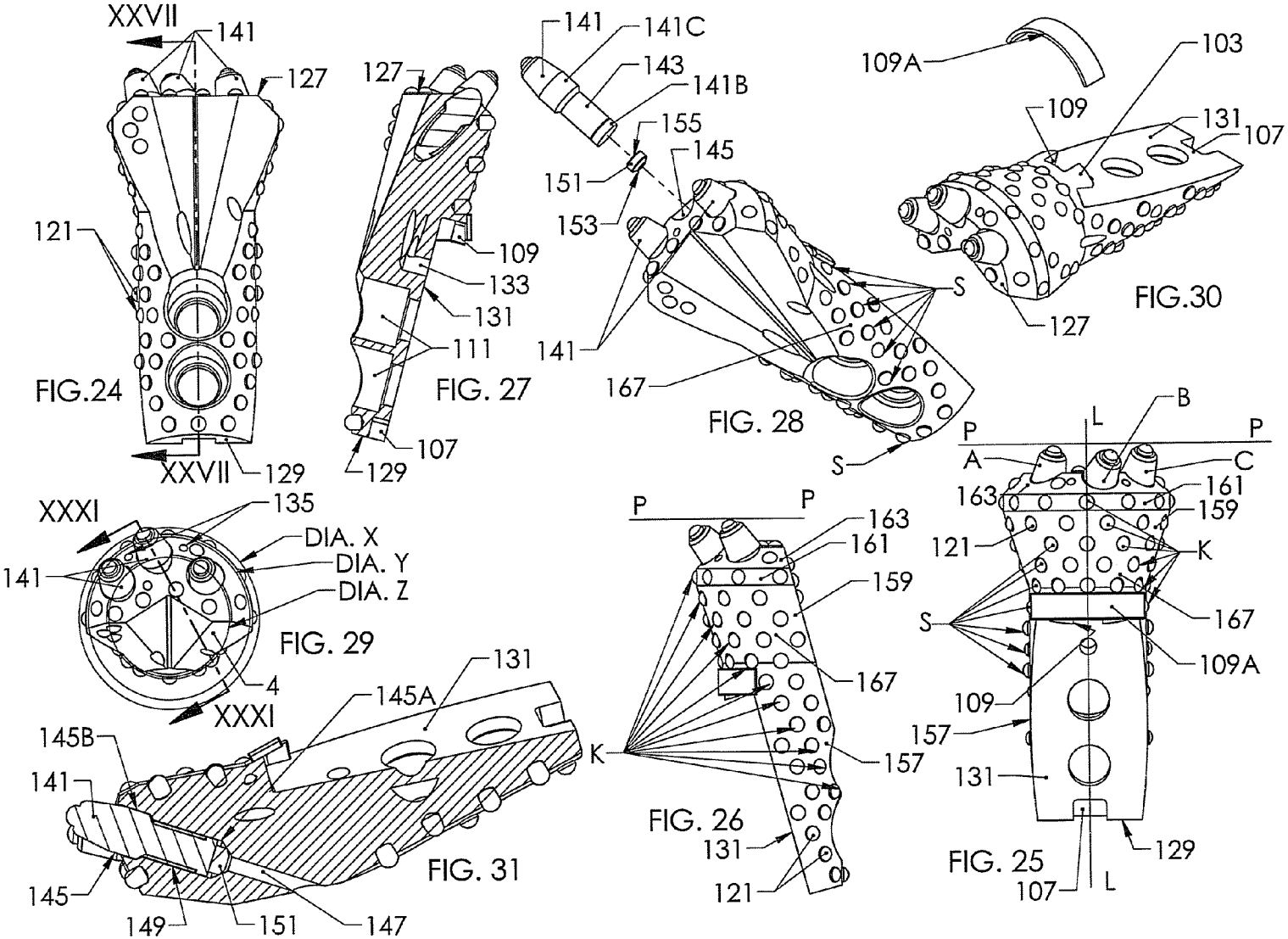
FIG. 24 is a top view of the tooth bit of FIG. 2.
FIG. 25 is a view of the bottom side of the tooth bit of FIG. 24.
FIG. 26 is a side view of the tooth bit of FIG. 24.
FIG. 27 is a cross-sectional view of the tooth bit, taken through lines XXVII-XXVII of FIG. 24.
FIG. 28 is a perspective view of the tooth bit showing a bullet tooth exploded therefrom.
FIG. 29 is a view of the front end of the tooth bit.
FIG. 30 is a perspective view of the tooth bit showing the front end and bottom sides.
FIG. 31 is a cross-sectional view of the tooth bit taken through lines XXXI-XXXI of FIG. 29.

With the use of spacers 151, the teeth can be set in a variety of configurations. Referring to FIG. 25, there are three teeth labeled A, B and C. An imaginary plane P is shown intersecting the tips of teeth A and C. The tip of tooth B is located rearward of plane P. Using a spacer 151, tooth B can be moved up to the plane P or even forward of the plane. Likewise, the forward positions of the other teeth can be adjusted with the spacer.

If tooth A, B, and C are in the same circular orbit then, due to the rotation in the drill bit, tooth C is the leading tooth and consequently strikes the rock most frequently. Teeth A and B are rotationally behind tooth A and may miss some rock due to the jolting and vibrations of the drill bit. Teeth A and B can be configured to project more forward and present a more aggressive tooth configuration to strike the rock more frequently. For example, tooth B can be adjusted to project slightly forward of the plane P. Tooth A can be adjusted to project the same distance as tooth B, slightly forward of tooth B. In some configurations the cutting orbits X, Y, and Z of the teeth as seen in FIG. 29 are not the same. The best angle of the teeth in relation to the cutting surface is determined by the manufacturer of the teeth.

The teeth tear and hammer the rock loose. Buttons 121 on the bit 4 crush the loose rock for easier removal from the borehole by the drilling fluid. The buttons are carbide and are secured to holes, or bores, in the bit by soldering or some other means.

The drill bit 4 arranges the buttons 121 in a spiral configuration. This promotes crushing in the rock and also displacement of the crushed rock rearward from the cutting face. The spiral configuration can be seen in FIGS. 24-26, 28 and 30 (the Figs. can be rotated to better see the spiral configuration). Before discussing this spiral configuration in more detail, a brief description of the various portions of the drill bit will now be provided.

The drill bit has, from the rear end toward the front end, a first cylindrical portion 157, a first frusto-conical portion 159, a second cylindrical portion 161, a second frusto-conical portion 163 and the front end 127. The first and second cylindrical portions 157, 161 are not full cylinders, but are only arcuate portions thereof. Likewise, the first and second frusto-conical portions 159, 163 are arcuate portions thereof. The first cylindrical portion 157 has the flat surface 131 and retainer pin openings 111. The first frusto-conical portion 159 is between the first and second cylindrical portions 157, 161. The second cylindrical portion 161 is between the first and second frusto-conical portions 159, 163. The front end 105 merges with the second frusto-conical portion 163. The first frusto-conical portion 159, the second cylindrical portion 161 and the second frusto-conical portion 163 are generally on the flat surface 131 side of the bit. The first frusto-conical portion 159 expands radially out from the first cylindrical portion to the second cylindrical portion. Conversely, the second frusto-conical portion 163 contracts radially from the second cylindrical portion to the front face 127. The second cylindrical portion is narrow in width (that is along a dimension that is parallel to the longitudinal axis).

In the preferred embodiment, the spiral button pattern is on the first cylindrical portion 157, the first frusto-conical portion 159 and the second cylindrical portion 161. Looking to FIG. 25, one button on the second cylindrical portion 161 intersects an imaginary line L. The button is one of a spiral line of buttons S. Referring to the orientation of FIG. 25, the spiral line continues up and to the left from the first button along the first frusto-conical portion 159 and on to the first cylindrical portion. Referring to the orientation of FIG. 28, the spiral line S continues up the first cylindrical portion 157 to the rear end 129. The line is not continuous due to a retainer pin opening 111. Furthermore, spiral lines need not be continuous and can have missing buttons. As can be seen, other spiral lines are formed, which spiral lines are generally parallel (in an arcuate sense) to one another.

Another set of spiral lines K is formed in the opposite direction. Referring again to the button of FIG. 25 on the second cylindrical portion and intersecting line L, its line K extends to the left and down the first frusto-conical portion 159, and along (as seen in FIG. 26) the first cylindrical portion 157. Thus, spirals can be provided with a right hand twist K or a left hand twist S, or both.

Gaps or channels 167 are formed between the spiral lines. As material is crushed by the buttons, the slurry of crushed material and drilling fluid moves rearwardly in these channels 167. The slurry is unobstructed by buttons. Material flows past the bit is thus enhanced.

Figure 32:
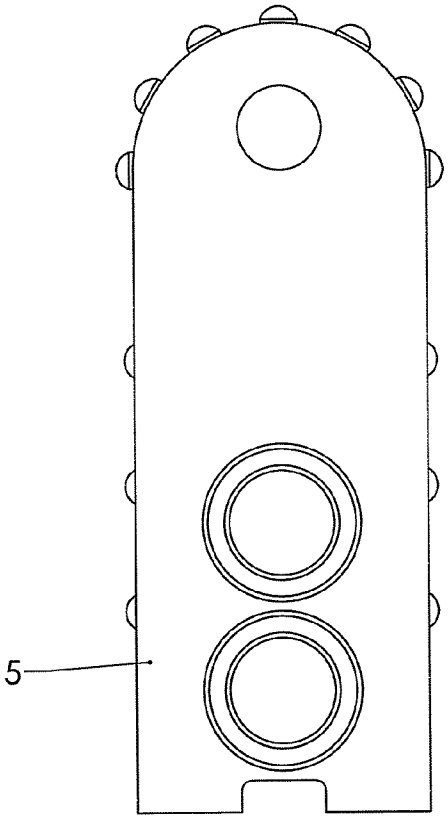
FIG. 32 is a top view of the blade of FIG. 3.
Figure 33:
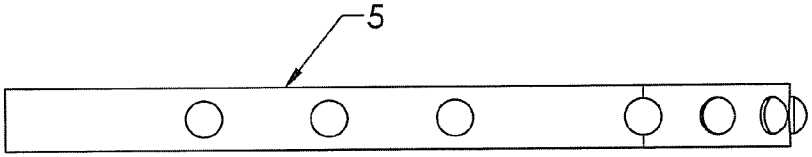
FIG. 33 is a side view of the blade of FIG. 3.

FIGS. 32-33 show a flat plate 5 useful for soft conditions. The blade is similar to the blade 3 of FIGS. 20-23 but lacks hooks. Because it is used in soft materials, it does not experience high side loading.

The tabs 83, 85 provide shear relief to the bit or blade during operation. The tabs have side surfaces 89, 95 that bear on the respective notches and absorb shear forces on the bit or blade. The forward tab 83 is provided underneath the mounting surface 65 (when the mounting surface is oriented on top as shown in FIGS. 16 and 18). The bit 4 and blades 3, 5 wrap around the forward end of the bit body 2 to engage the forward tab 83. Likewise, in the embodiment shown in FIGS. 34-37, the bands 109D, 109E, and the tab 85 provide shear relief to the drill bit and serve to prevent side-to-side movement of the drill bit on the bit body.

Thus, the tabs and the bands provide lateral surfaces relative to the longitudinal axis of the bit body, which lateral surfaces minimize lateral movement of the bit relative to the bit body during drilling operations. By so doing, shear forces between the bit and the bit body are minimized.

Not only does this arrangement make for an exceptionally strong coupling, but it allows for easy change out of one bit for another bit, or one blade for another blade, as well as for easy substitution of a blade for a bit and vice versa.

Thus, the single bit body 2 can be used with a rock bit 4, a blade 3 for moderate conditions and a blade 5 for soft conditions.

Figure 38:
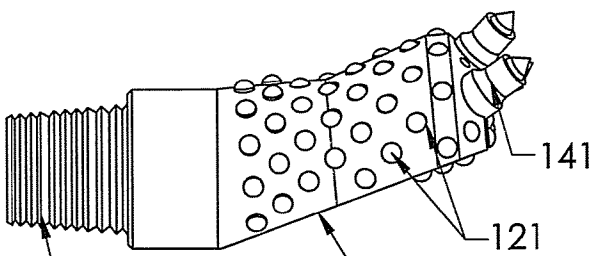
FIG. 38 is a side view of the rock bit, in accordance with another embodiment.

FIG. 38 shows a rock bit 4B in accordance with another embodiment. The rock bit 4B is substantially similar to the rock bit 4 described above, with the exception that the rock bit is integral to the bit body to form a single component that threads into the drill string.

The foregoing disclosure and showings made in the drawings are merely illustrative of the principles of this invention and are not to be interpreted in a limiting sense.

The invention claimed is:

1. A horizontal directional drilling sonde housing, comprising:

a) first and second ends, with the first end capable of coupling to a drill string, a mud channel extending in between the first and second ends;

b) a cavity located in the housing and separate from the mud channel, an opening allows access to the cavity from an exterior of the housing, the cavity capable of receiving a sonde;

c) a door for closing the opening;

d) signal channels extending from the cavity to the exterior of the housing, each of the signal channels comprising an intermediate section and an exterior section, the intermediate section being smaller in a first dimension than the exterior section;

e) a polymer lining at least part of the cavity so as to be interposed between the sonde and the housing, the polymer filling the signal channels, the polymer located in the intermediate and exterior sections and filling both sections.

2. The horizontal directional drilling sonde housing of claim 1, wherein:

a) the intermediate section is smaller in a second dimension than the cavity;

b) the polymer in the cavity, the intermediate section and the end section being integral.

3. The horizontal directional drilling sonde housing of claim 1, wherein:

a) the door comprises a signal channel;

b) the polymer and the door signal channel is "I" shaped in transverse cross-section.

4. The horizontal directional drilling sonde housing of claim 1 further comprising a debris seal around the opening, the seal contacting the door.

* * * * *